US005324406A

United States Patent [19]

Anderson et al.

[11] Patent Number: 5,324,406

[45] Date of Patent: Jun. 28, 1994

[54] AUTOMATIC BRUSH PLATING MACHINE

[75] Inventors: Edward M. Anderson, Johnstown; Martin L. Blazic, Pickerington; Susan M. Lannutti, Columbus, all of Ohio

[73] Assignee: Tosoh SMD, Inc., Grove City, Ohio

[21] Appl. No.: 942,949

[22] Filed: Sep. 10, 1992

[51] Int. Cl.[5] ..... C25D 17/16

[52] U.S. Cl. ..... 204/224 R; 204/225

[58] Field of Search ..... 204/224 R, 225; 205/117; C25D 17/14

[56] References Cited

U.S. PATENT DOCUMENTS

| | | | |
|---|---|---|---|
| 3,290,236 | 12/1966 | Mayer | 204/224 |
| 3,723,283 | 3/1973 | Johnson et al. | 204/206 |
| 3,751,343 | 8/1973 | Macula et al. | 204/15 |
| 3,779,887 | 12/1973 | Gildone | 204/224 R |
| 3,810,829 | 5/1974 | Fletcher | 204/222 |
| 3,977,957 | 8/1976 | Kosowsky et al. | 204/224 |
| 4,003,805 | 1/1977 | Schaer et al. | 204/27 |
| 4,404,078 | 9/1983 | Francis | 204/202 |
| 4,452,684 | 6/1984 | Palnik | 204/206 |
| 5,003,352 | 3/1991 | Duchesne et al. | 355/256 |
| 5,045,167 | 9/1991 | Palnik | 204/206 |

*Primary Examiner*—Kathryn Gorgos

*Attorney, Agent, or Firm*—Biebel & French

[57] ABSTRACT

An automatic electrodeposition apparatus is disclosed. The desired substrate is brush plated by moving the brush on top of the plate. The brush may be selectively, and sequentially supplied with any one of a number of working solutions comprising conventional cleaning and plating solutions. De-ionized water and pressurized air may also be selectively fed to the brush for cleaning at desired time or job intervals throughout operation of the machine. A programmable logic controller controls feed of working solution, water, and air flow to the brush. It also controls brush movement and monitors electrodeposition through measurement of ampere-hours spent during operation.

11 Claims, 14 Drawing Sheets

B
232
STOP INPUT ?
Y
N
234
INCREMENT STEP COUNTER +1
236
IS STEP COUNTER = 1 ?
YES
N
238
TRANSFER STEP 1 INTO CURRENT RUN REGISTER
240
IS STEP COUNTER = n ?
YES
N
242
TRANSFER STEP n INTO CURRENT RUN REGISTER
244
IS STEP COUNTER = 9 ?
N
246
DISCRETE REFERENCE END CYCLE ON
I
C

AUTOMATIC BRUSH PLATING MACHINE

BACKGROUND OF THE INVENTION

This invention relates to the electrodeposition of plating materials on a substrate and, more specifically, to the automatic electrodeposition of plating materials on a metallic substrate that is to be used subsequently as either a target or a backing plate member for sputtering.

In electrodeposition processes, the desired plating material must be electrically charged. This is accomplished by polarizing the plating material opposite to the substrate charge polarity. In brush plating, a brush containing the plating material is charged, and the metallic substrate is charged opposite that of the brush. Therefore, the plating material departs from the brush and is transferred and bonded to the substrate.

Generally, the desired plating material is supplied to the brush by either presoaking the brush or by supplying the plating material directly to the brush. Prior to brush plating, the surface of the substrate must be cleaned. After this preparation, the substrate is placed onto the machine ready for electrodeposition.

An example of brush plating is disclosed in U.S. Pat. No. 4,404,078 wherein the parts to be plated are moved along a conveyor while selected portions of the parts are plated by passing through an electroplating cell. A brush is used to provide the cathode connection for the parts during the electroplating process.

Another example of electrodepositing by brush plating is disclosed in U.S. Pat. No. 4,452,684. The '684 patent discloses a selective electroplating device that uses a stationary brush member and associated anode. The brush is comprised of a porous material and has a surface which transfers charged electrolytic solution to the selected surfaces of the parts.

Still another example is disclosed in U.S. Pat. No. 3,290,236. The '236 patent discloses a pad attached to a head with the electrolytic solution supplied to the pad through the head. The pad receives an electrical charge through the head for effecting electrodeposition to the work piece.

A further example of electrodeposition by brush plating is disclosed in U.S. Pat. No. 3,751,343. The '343 patent discloses brush plating by rotating or vibrating the anode which is covered with a porous dielectric cover. The electrolyte is supplied to the anode brush through a tube which directs the electrolyte into the brush material.

Other patents which may also be of interest include U.S. Pat. Nos. 5,045,167 (Planik); 3,810,829 (Fletcher); 3,977,957 (Kosowsky); 4,003,805 (Schaer et al); and 3,723,283 (Johnson et al.).

Despite the contributions of the prior art, there is a need to provide an automatic brush plating machine which will uniformly brush plate a precise desired amount of material along the entire surface of the substrate. There is an even more specific need to provide such an automatic machine wherein the brush may be sequentially supplied with one of a variety of working solutions so that the machine can automatically perform a variety of plating or cleaning functions on the desired workpiece.

SUMMARY OF THE INVENTION

In accordance with the present invention, an electrodeposition apparatus is used to automatically brush plate a substrate, such as metal plate, for the subsequent use of the plate as a target or associated backing plate in cathodic sputtering operations. The anodic plating brush moves along the substrate and can be sequentially provided with one or more working solutions to provide for effective surface preparation and plating of the substrate.

The working materials to be supplied to the plating brush are disposed in a series of reservoirs and each or a combination can be selectively pumped to the brush. A controller controls the entire automatic operation of the plating machine by controlling the voltage, current, working material, and the application of each material to the plate as measured in ampere-hours. Additionally, the brush may be cleaned and dried after the working solutions have been applied to the substrate.

As used herein, the phrase "working solutions" will comprise electroplating, cleansing and pretreatment solutions.

Other objects and advantages of the present invention will be apparent from the following description and the accompanying drawings.

DETAILED DESCRIPTION OF THE PREFERRED EMBODIMENT

Figure 1:
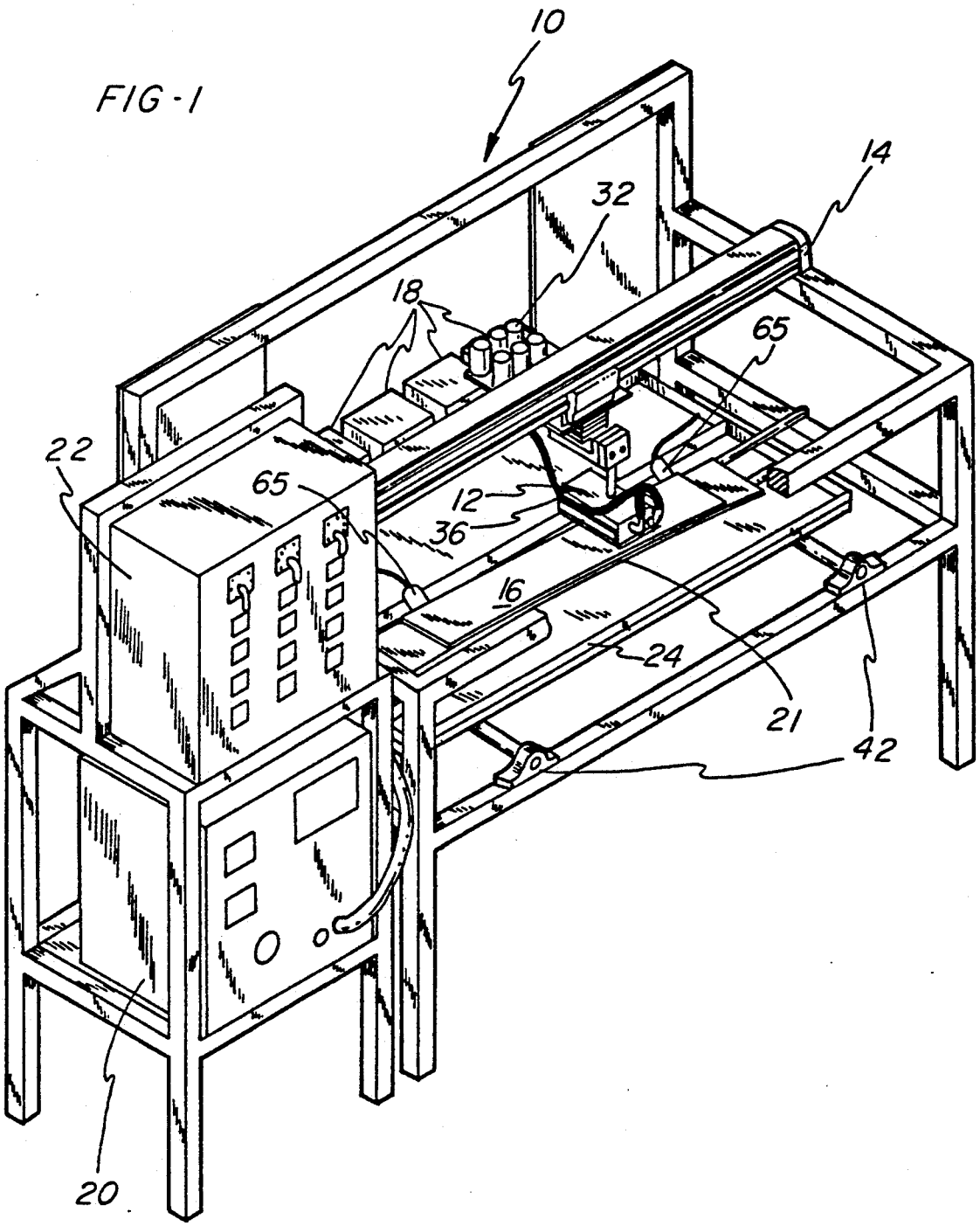
FIG. 1 is a perspective view of the automatic electrodeposition machine of the present invention.

Turning now to FIG. 1, the brush plating machine 10 includes brush assembly 12 which slides along rail 14. The substrate 16, having two ends and a surface defining a horizontal plane, is electrodeposited with a material, such as nickel, from brush assembly 12. The material is fed to the brush assembly 12 by one of the pumps 18. The powerpack 20 feeds a current to the assembly 12 and maintains a voltage across the assembly 12 and substrate 16.

The machine 10 and the powerpack 20 are controlled by a controller 22. Controller 22 controls the steps of preparing the substrate 16 for electrodeposition of the desired material onto the substrate. The controller 22 also controls the position of the tray 24 which is positioned under substrate 16 and is used to catch any runoff of the plating or cleaning solutions from the substrate 16. As shown, substrate 16 is superposed over support member 21 typically stainless steel (broken away for clarity in FIG. 1).

In use, the controller 22 is set for a specific program and started. The powerpack 20 supplies the correct current and voltage to the brush assembly 12. Furthermore, the controller 22 moves the brush assembly across the substrate 16 horizontally in back and forth motion until the desired amount of material has been applied to substrate 16.

The amount of material deposited on the substrate 16 is directly related to the amount of ampere hours that have flowed through the brush assembly 12 to the substrate 16. Therefore, once a predetermined amp hour limit has been reached, then the desired amount of material has been electrodeposited onto the substrate 16. Once the electrodeposition is completed, the controller 22 moves the brush assembly 12 up and off the substrate 16 for removal.

Figure 5:
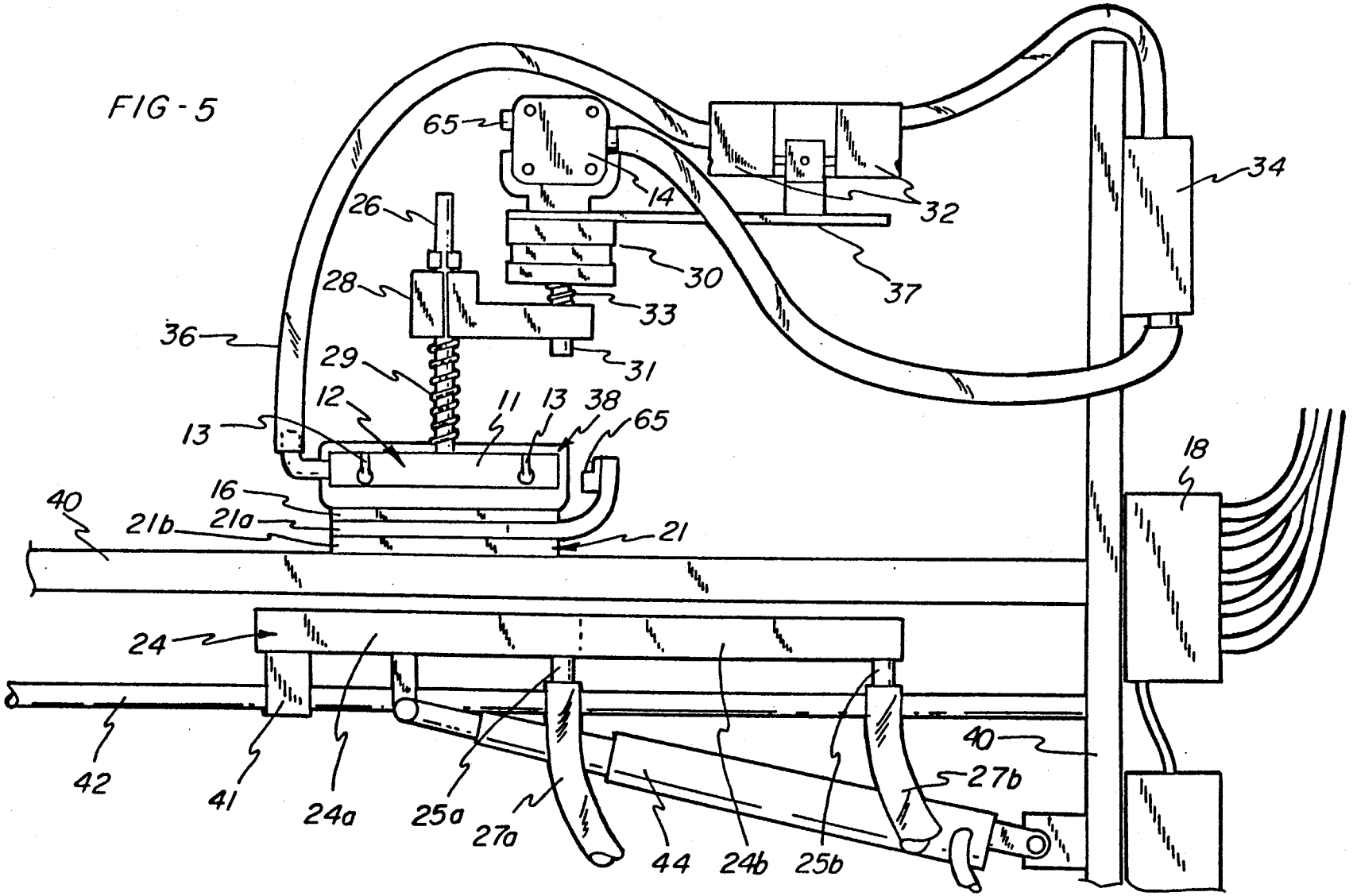
FIG. 5 is magnified side view of the brush and associated mechanisms.

Referring to FIG. 5, brush assembly 12 preferably comprises a porous block material 11, such as a polypropylene block that is provided with an electrically conductive face such as a platinum-niobium screen. The block 11 has an absorbent pad material 38 wrapped around it. The absorbent material 38 is a material such as a "SCOTCH BRITE WHITE" absorbent pad manufactured by 3M Company. The pad material 38 evenly distributes and electrodeposits the desired working solution onto the surface of the substrate 16. The absorbent pad material 38 is attached to block 11 by wrap retainers 13.

The block 11 is mounted to an electrode 26 which is, in turn, mounted to an electrode bracket 28. Around electrode 26 is a tension spring 29 located between block 11 and bracket 28 for maintaining the proper pressure against the substrate 16 at all times. The electrode bracket 28 is mounted to a pneumatic "pancake" cylinder 30, such as are available from Bimba Manufacturing Co., Monee, Ill., through a cylinder rod 31 which also has a tension spring 33 surrounding it. Upward and downward motion of the pneumatic cylinder 30 toward and away from substrate 16 is controlled by the controller 22. The entire brush assembly 12 is mounted for horizontal travel along rail 14.

The rail 14 is preferably a rodless band cylinder, such as a Tol-A-Matic Model No. BC100-150P, and via pneumatic actuation controlled by controller 22, moves the brush assembly 12 horizontally along the substrate 16 from left to right and right to left (FIG. 1) for electrodepositing working solution onto the substrate 16.

Tray 24 (FIG. 1), located underneath the substrate 16 (see FIGS. 1 and 5 especially), is divided in two sections **24*a* and 24*b* (FIG. 5) and slides fore and aft along the tray rails 42 on slide bearings 41 for catching any runoff of the excess working solution from the substrate 16. Tray sections 24*a* and 24*b* each have a drain 25*a,b* for draining the runoff into separate containers through respective hoses 27*a,b*. Again, controller 22 controls the positions of the tray 24 through air cylinder 44 and dictates whether section 24*a* or section 24*b* will be positioned under the substrate to catch run-off. For example, in accordance with this aspect of the invention, a toxic or expensive material, such as nickel when used as a working solution, can be caught in a separate section, section 24*b*, and recovered for recycling or reuse. Other non-toxic or less expensive working solutions may be caught in the other section, section 24*a***.

A plurality of sensors 65 (FIGS. 1, 2, 5 and **5*a*) are positioned along rail 14 and support 21 to sense the position of the brush assembly 12 to determine the location of brush assembly 12 on rail 14**. The type of sensors used are preferably optical sensors, such as an Econo-Beam photo electric sensor, Model No. SE612D, provided by Banner.

A plurality of pneumatic diaphragm valves 32 (FIG. **5*a*) feed a plurality of individual working solutions to the brush assembly 12. The valves are attached to the brush assembly by support 37. The valves 32 control feed of the brush through hose 36 and associated inlet ports (FIGS. 5 and 2) in block 11. Referring now to FIG. 3, pumps 18 feed working solutions disposed in reservoirs 99*a–e* to pneumatic diaphragm valves 32. The pumps 18** are preferably peristaltic pumps, such as those made by Anko Products MITYFLEX® Series 900–909 peristaltic pumps.

Operation of the diaphragm valves 32 is controlled by the controller 22 through a plurality of solenoid-controlled valves 34. Once the controller 22 determines which material should be supplied to the brush hose 36, the controller will activate the appropriate diaphragm valve 32, via the solenoid-controlled valves 34, to supply that material directly to the brush 12 through hose 36 and associated ports.

Figure 6:
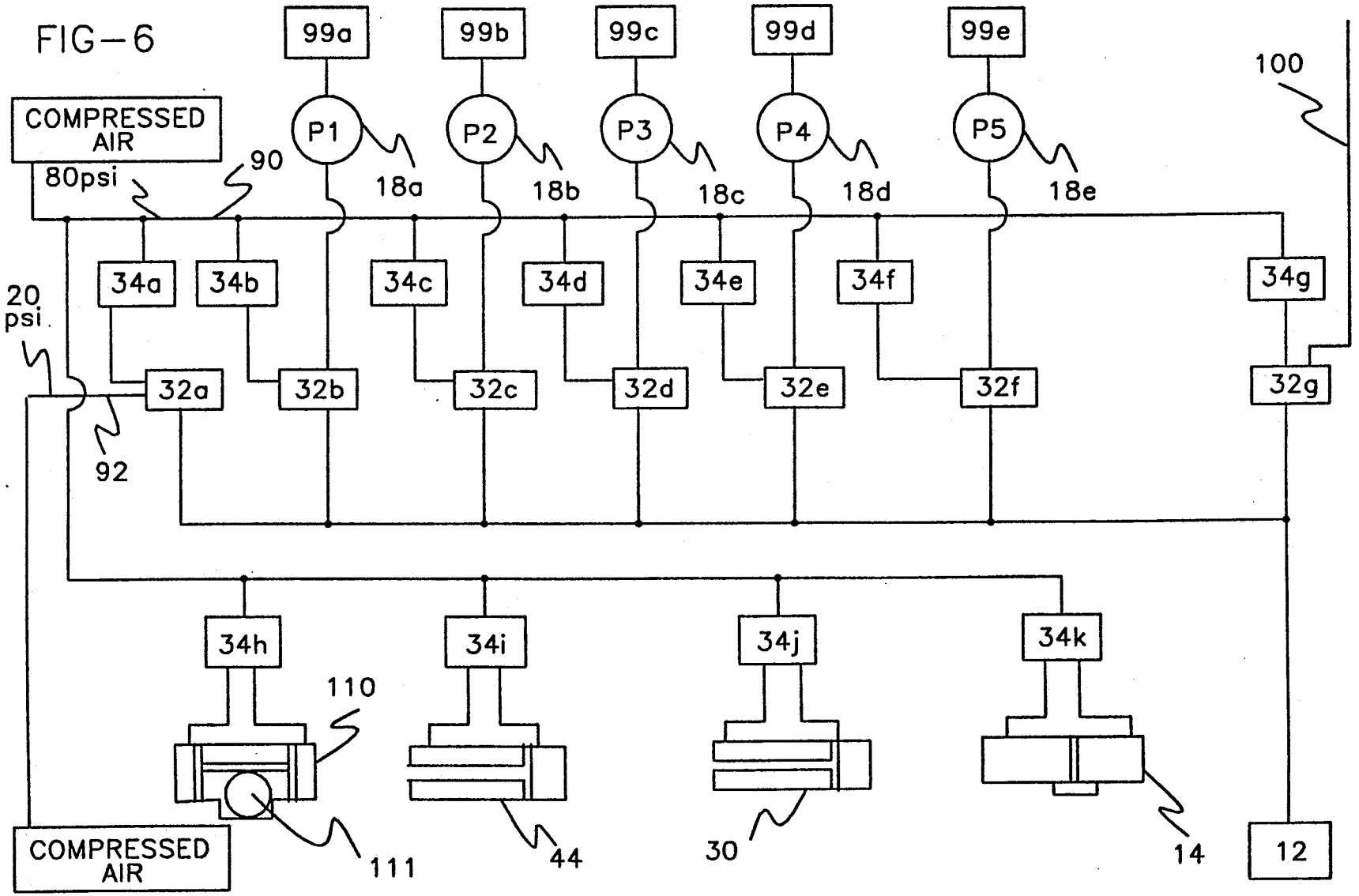
FIG. 6 is a schematic diagram of the pneumatic controls used to regulate various functions of the machine.

Referring more specifically to FIG. 6, the air pressure for the pneumatic system is supplied through line 90, which is regulated at 80 psi, and line 92 which is regulated at 20 psi. Filters and pressure regulators are connected to lines 90, 92 but are omitted from the instant drawings. The controller 22 controls the priming of pumps **18*a–18e* and solenoid-controlled valves 34*a–34g*. The pumps 18*a–18e* supply working solutions to the diaphragm valves 32*b–32f*, respectively, from reservoirs 99*a–e*. The controller 22 controls the opening and closing of the solenoid valves 34*a–34g* which in turn controls opening and closing of the diaphragm valves 32*a–32g***.

When, for example, the controller 22 determines that deionized water should be supplied to the brush assembly 12 the controller will maintain solenoids **34*a–34f* closed and open solenoid 34*g* which will maintain diaphragm valves 32*a–32f* closed and open diaphragm valve 32*g* thereby supplying deionized water to brush assembly 12 through water line 100**.

In the same manner, if working solution from pump **18*c* is to be supplied to brush assembly 12, then solenoid valves 34*a–34c*, 34*f* and 34*g* are maintain closed and solenoid valve 34*d* is opened thereby allowing air pressure to open diaphragm valve 32*d* to supply this solution to brush assembly 12. The other working solutions and air supply to the brush assembly 12 are all controlled in the same manner by the controller 22. In this manner, it can be appreciated that any one of the working solutions from pumps 18*a–e* (and associated reservoirs 99*a–e*), or deionized water from line 100 may be fed to brush assembly 12** for electroplating and/or cleaning functions.

Also, in FIG. 6, voltage high and low conditions on the power pack 20 are controlled through the controller by pneumatic rotary cylinder 110, such as a Bimba rotary cylinder PT-037-090-A1. If a low voltage is set then the solenoid **34*h* is opened by the controller 22 to allow the rotary cylinder 110 to pneumatically rotate the dial 111 on the powerpack to the low voltage setting. Likewise, if the high voltage is set, then the controller 22 will close the low voltage part of the solenoid 34*h* and open the high voltage part thereby rotating dial 111** to the high voltage setting.

Solenoid valve **34*a* controls use of 20 psi purge air flow to brush assembly 12. Here again, this valve 34*a* is controlled via a pulse received from controller 22. Diaphragm valve 32*a* is normally closed, requiring actuation from associated solenoid valve 34*a*** before purge air is admitted to the brush.

Solenoid valve **34*i* controls the position of trays 24*a*, *b* underneath the substrate. This valve 34*i* actuates air piston 44 to selectively move either tray portion 24*a*** or

*b* under substrate 16 to catch overflow of working solution from the substrate.

Up and down movement of the brush assembly 12 and associated anode from the substrate is actuated via pulse from controller 22 sent to solenoid valve 34J which adjusts pancake cylinder 30 in the desired up or down position.

Similarly, horizontal, left to right and right to left travel of brush assembly 12 and associated anode along rail 14 is controlled via solenoid valve 34*k*.

Figure 2:
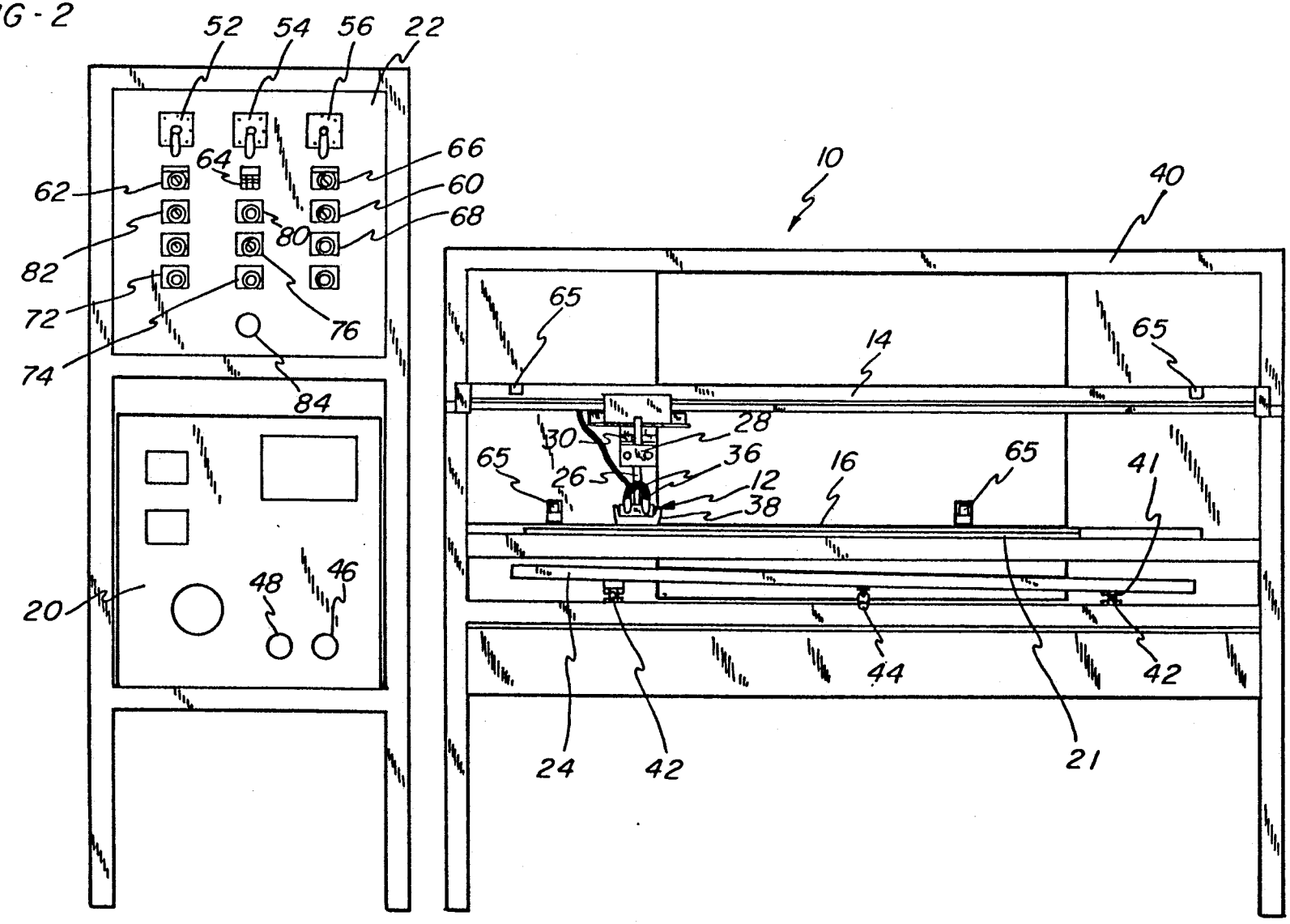
FIG. 2 is a front view of the machine.
Figure 3:
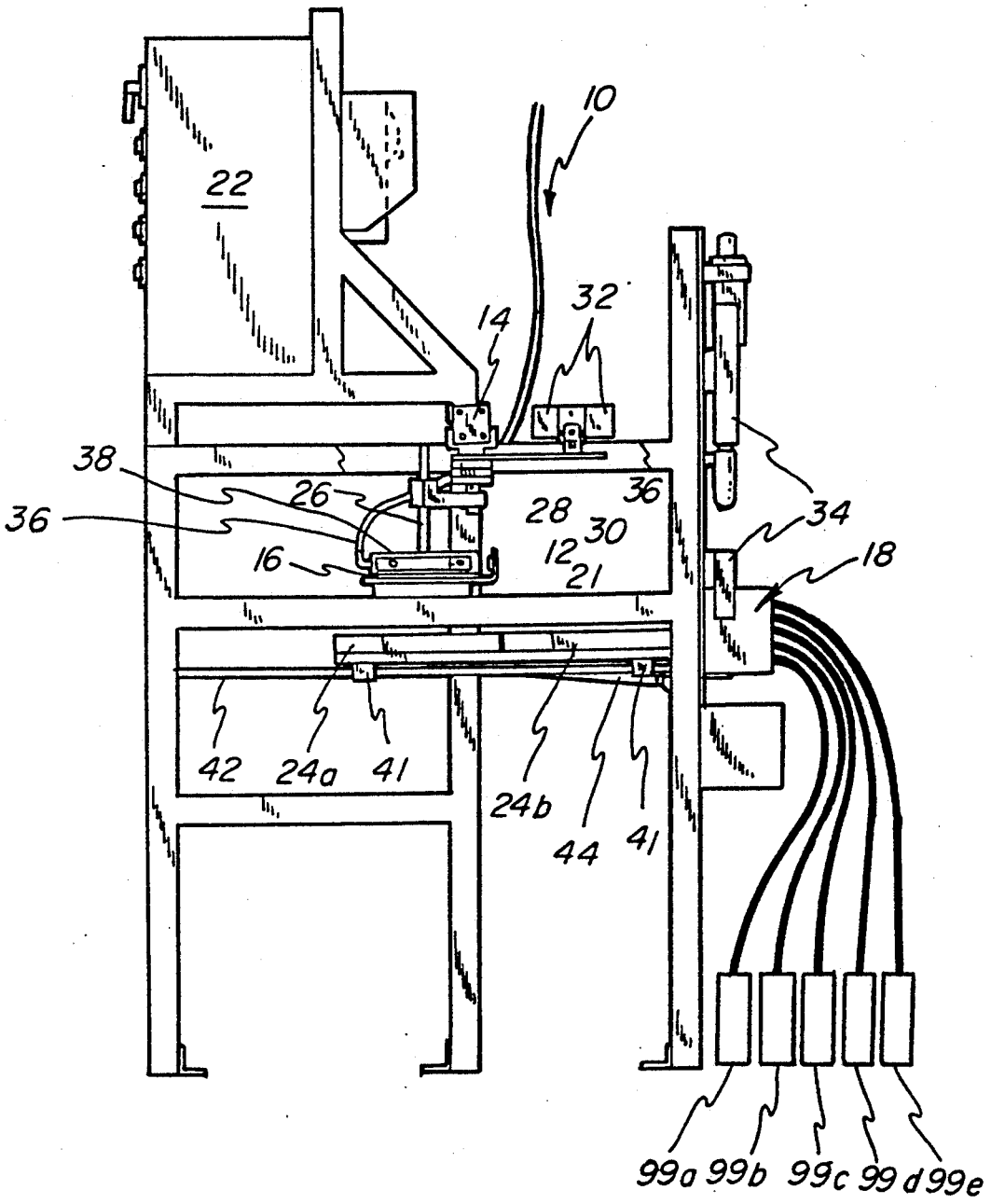
FIG. 3 is a side view of the machine looking through the brush plating apparatus to the controller and power supply.
Figure 4:
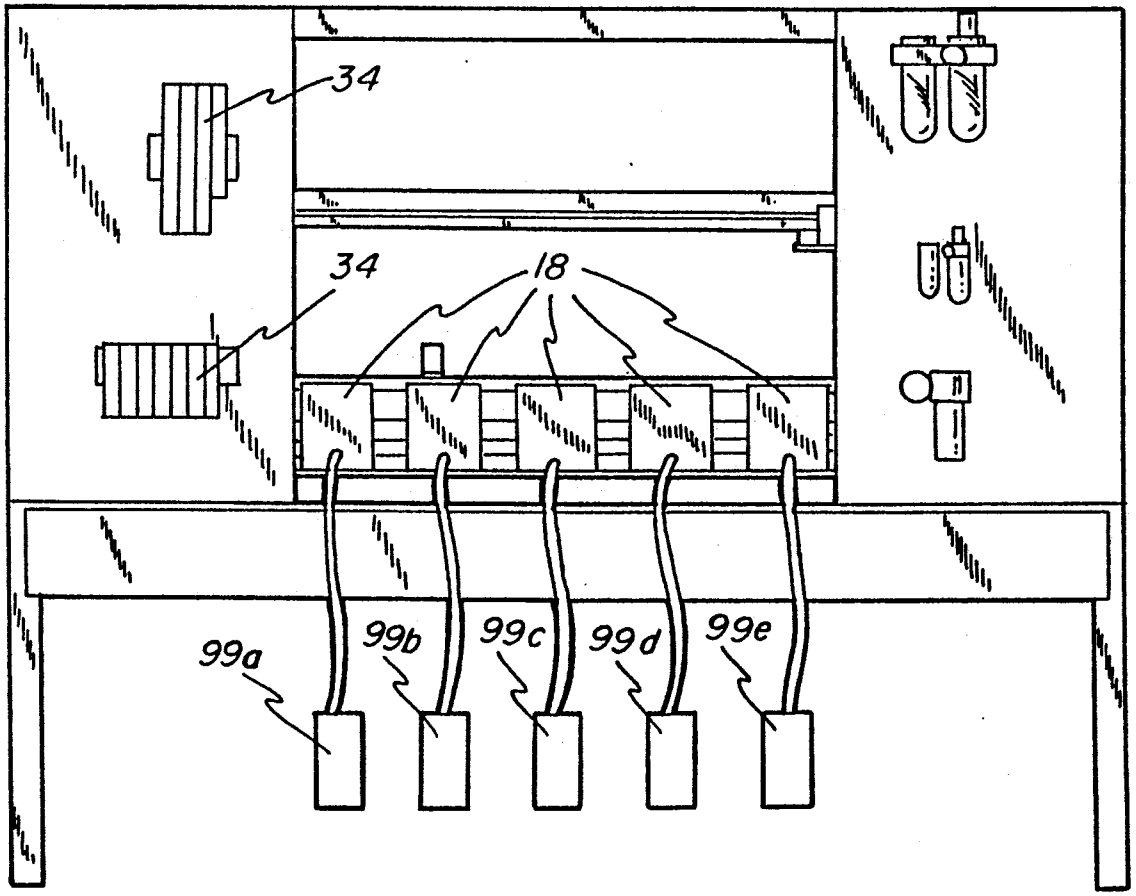
FIG. 4 is a rear view of the machine.
Figure 5A:
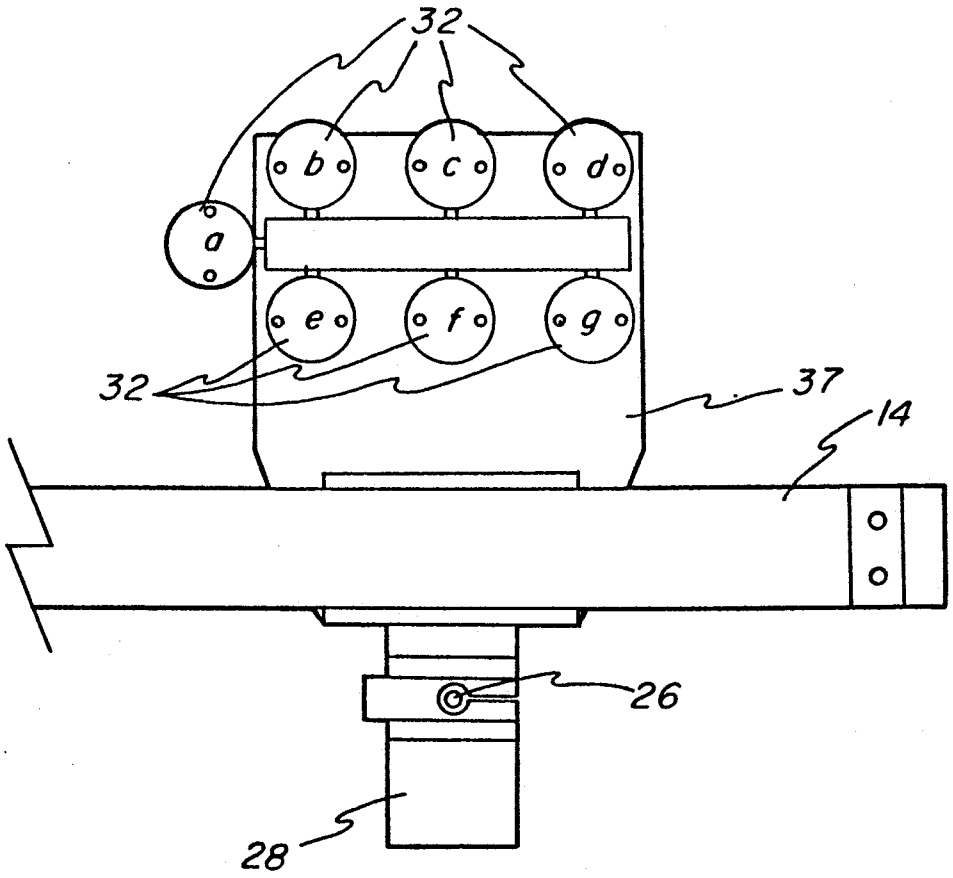
FIG. 5*a* is a magnified top view of the brush and associated mechanisms.

Referring to FIGS. 2 and 5, the powerpack 20 supplies an electrical current to the brush assembly 12 from positive terminal 46 to the electrode 26. The polarity of the voltage supplied to the brush assembly 12 can be changed so that it can be charged either as an anode or cathode. Herein it is assumed that the brush assembly 12 is charged as an anode. The negative terminal 48 or ground terminal of the power pack 20 is connected to the substrate support 21 which has a stainless steel top 21*a* attached to a poly vinyl chloride sheet 21*b* (FIG. 5*a*) to insulate the support 21 from the support rack 40. The voltage supplied is a low voltage such as 10 volts or 15 volts. The low voltage is sufficient to continue the current flow from the brush assembly 12 to the substrate 16, thereby electrodepositing the working material supplied to the brush assembly 12 onto the substrate 16.

As stated above, the controller 22 controls the power pack 20 thereby maintaining the appropriate voltage and current fed to the brush assembly 12. Once the current, measured in amp hours, reaches a certain level, indicating the completion of all steps, the controller 22 shuts off the powerpack 20 thereby discontinuing the supply of voltage and current to the brush 12.

In the automatic operation of the present invention, a particular program is selected which had been preprogrammed previously (programming is described below). The start button is pressed, which automatically begins a several step process of electrodepositing a material on the substrate 16. During any operation of the present invention, either manual or automatic, an interface display, such as Horner Electric's Operator Interface Unit, Model No. HE6930IU150 coupled to processing unit of the controller 22, is continually displaying which step is in process and the amp hours during electrodeposition on the substrate 16.

In the manual operation of the present invention and with reference to FIG. 2, the appropriate parameters are set on the controller 22 via the program 52, step 54 and solution 56 switches and the start button 68 is pressed. Each step of the process in the manual mode must be set up and started by the operator by using the manual switches for voltage 66,62, amp hours 64, water 72, air 74, brush up/down 76 and stop 78. It should be noted, that any of the selector switches on the controller 22 can be interchanged with a variety of switches which can include an infinite amount of settings for programming the controller 22 and controlling the electrodeposition process.

The controller 22, which preferably is a GE Fanuc Series 90 programmable controller, is programmed by an operating program, for example, the Logic-Master TM 90, v.2.04, for General Electric Fanuc Automation (PLC). The programming software allows one to create a program written in ladder logic for controlling the operations of a piece of machinery through a programmable controller. FIGS. 7 through 14 are flow charts of the program written to control the present invention.

As stated above, the present invention can be operated manually or automatically. The flow charts will mainly discuss the programming of the present invention for the automatic operation of the brush plating of a target.

Figure 7:
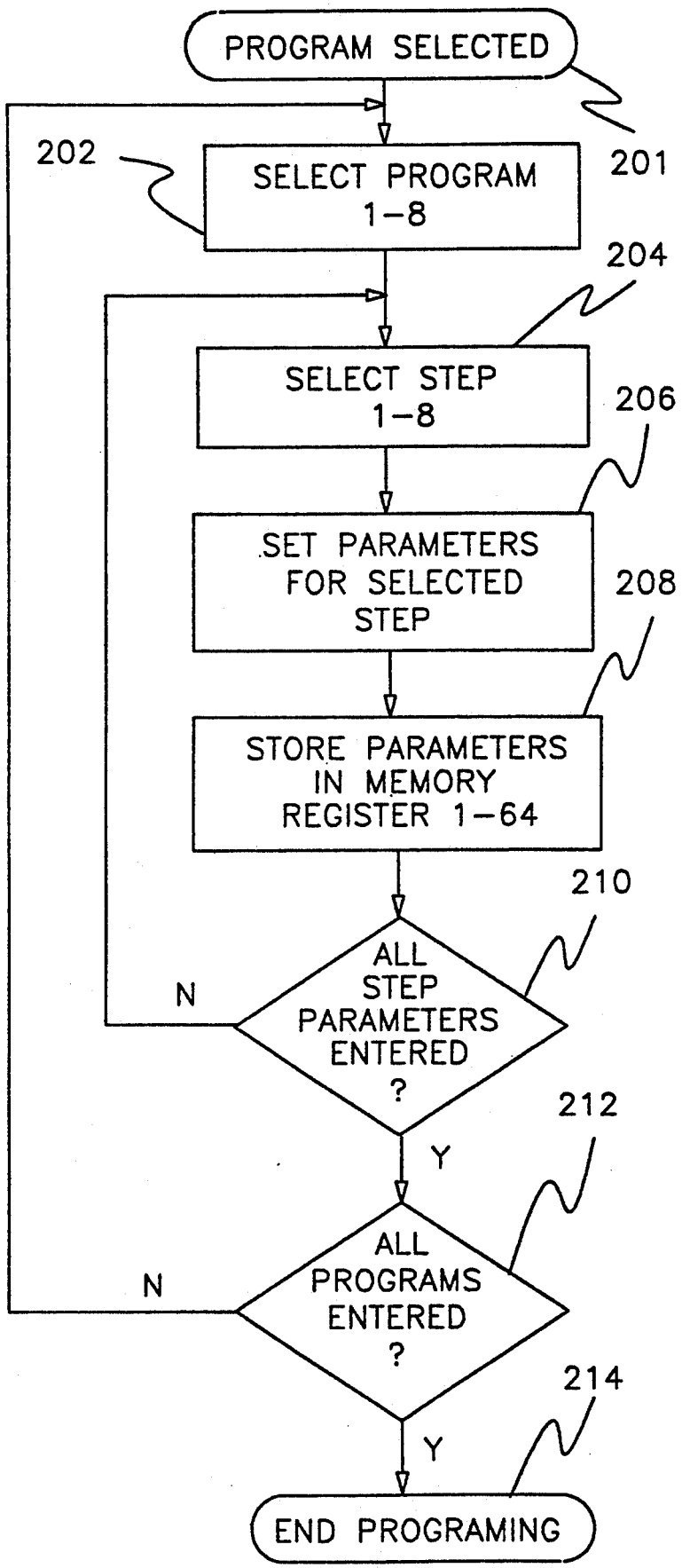
FIGS. 7 through 14 are flow charts of the PLC control of a variety of functions of the machine.

Referring to FIGS. 2 and 7, the mode switch 82, which has two settings PROG or RUN, is first set to the PROG position 201 for programming the various programs and steps into the controller 22. A program is selected 202, 1–8, from the program select switch 52. The program select switch 52 is a rotating switch having eight settings. The program select switch 52 could be any type of switch which could select an infinite amount of programs. Once a program is selected for programming, for example Program 1, the first step of Program 1 is selected 204 on the step selector 54. The parameters to be entered in the first step of the program 206 are also selected. These parameters include the setting of the voltage on the high or low voltage switch 62, the amp hours on thumb wheel switch 64, the voltage polarity to POS or NEG on switch 66, and the solution number, 1 through 6 on switch 56.

The inputted parameters 206 are stored 208 in a single memory register, register 1, by pressing the ENTER switch 80 on the control panel. The parameters for one step are stored as a string of bits, in sequence, in a single memory register. When the controller 22 needs to access the parameters it will look at a single bit of information from the string of bits that represents a particular parameter and will set up that particular parameter based upon that single bit. For example, the controller 22 will always look at bit position 1 in the string of bits to set up the voltage parameter.

There is a possibility of eight steps to be entered under each of the eight programs, thus 64 memory registers are needed. Once Step 1 is entered then Step 2 is selected 210 on switch 54. The parameters for Step 2 are selected and stored in memory register 2 in the same sequence as mention above. This is continued until all the steps, steps 1–8, are entered under Program 1 in memory registers 1–8. Once the parameters of Program 1 are entered, the programming can end 214 or the parameters for Programs 2 through 8 can be entered 212 into memory register 9–64 using the same process described above.

Figure 8:
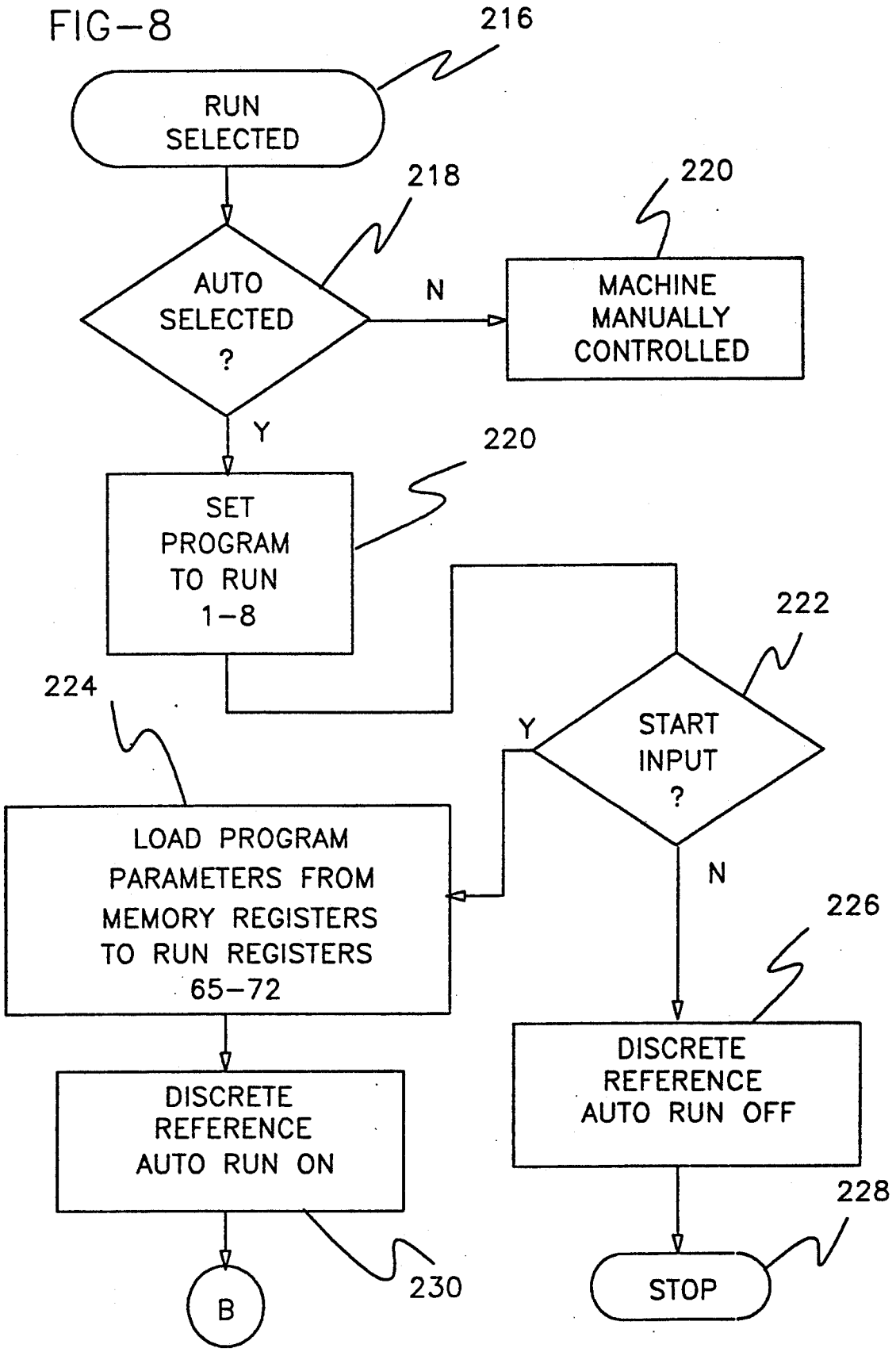

In FIG. 8, once all or one of the programs has been entered, a program can be run 216. FIGS. 8 through 14 describe the operation of any of the stored programs selected on the control panel.

Referring to FIGS. 2 and 8, a program is selected 216 on the program selector switch 52. The mode switch 60 must be turned to AUTO 218 and the mode switch 82 must be turned to RUN 216 in order to run a program automatically. If the mode switch 60 is set to MAN 220, the operator, for each step, must manually operate the machine by selecting the solution 54, voltage 62, voltage polarity 66, amp hours 64 and then press the start switch 68.

If the operator chooses the automatic mode of operation then all he has to do is press the start switch 68 and the selected program will automatically run all of the steps. For example, if the program is set to Program 1, 220, and the Start switch 68 on the control panel is depressed 222, then the parameters 224 that were programmed into Program 1 are retrieved from the memory registers 1 through 8 and entered into the run registers 65 through 72 of the controller 224. Once the run registers are filled 224, the discrete reference AUTO- RUN of the controller 230 is maintained ON and the program will run. If the Start switch 68 is not depressed, then the discrete reference AUTORUN 226 of the controller is maintained OFF and the automatic cycle will not begin 228.

As a precautionary measure, at any time during the program cycle, if the Stop button 78 is depressed on the control panel 232 (FIG. 9), then the program will abort and the brush assembly 12 will move up 248 (FIG. 10), and to the right 250 of the substrate. If the Emergency Stop button 84 is depressed, then the brush 12 will move up 248, to the right 250 and will cut off the voltage supplied to the brush.

Referring again to FIG. 9, when the program is initially started the step counter is set at 0. The step counter is then incremented by one 234 to initiate the following step, for example Step 1 of Program 1. If the counter is equal to 1, 236, then the current step parameters for Step 1 in run register 65 are transferred into a current run register 238. Each time the program cycles through the increment step counter 234, the counter is incremented by one and the subsequent step is performed 240 as indicated by an n. As stated above, the parameters for Step n which are in one of the run registers 65 through 72 are transferred into a current run register 242 and accessed by the controller for that step of the program.

Figure 11:
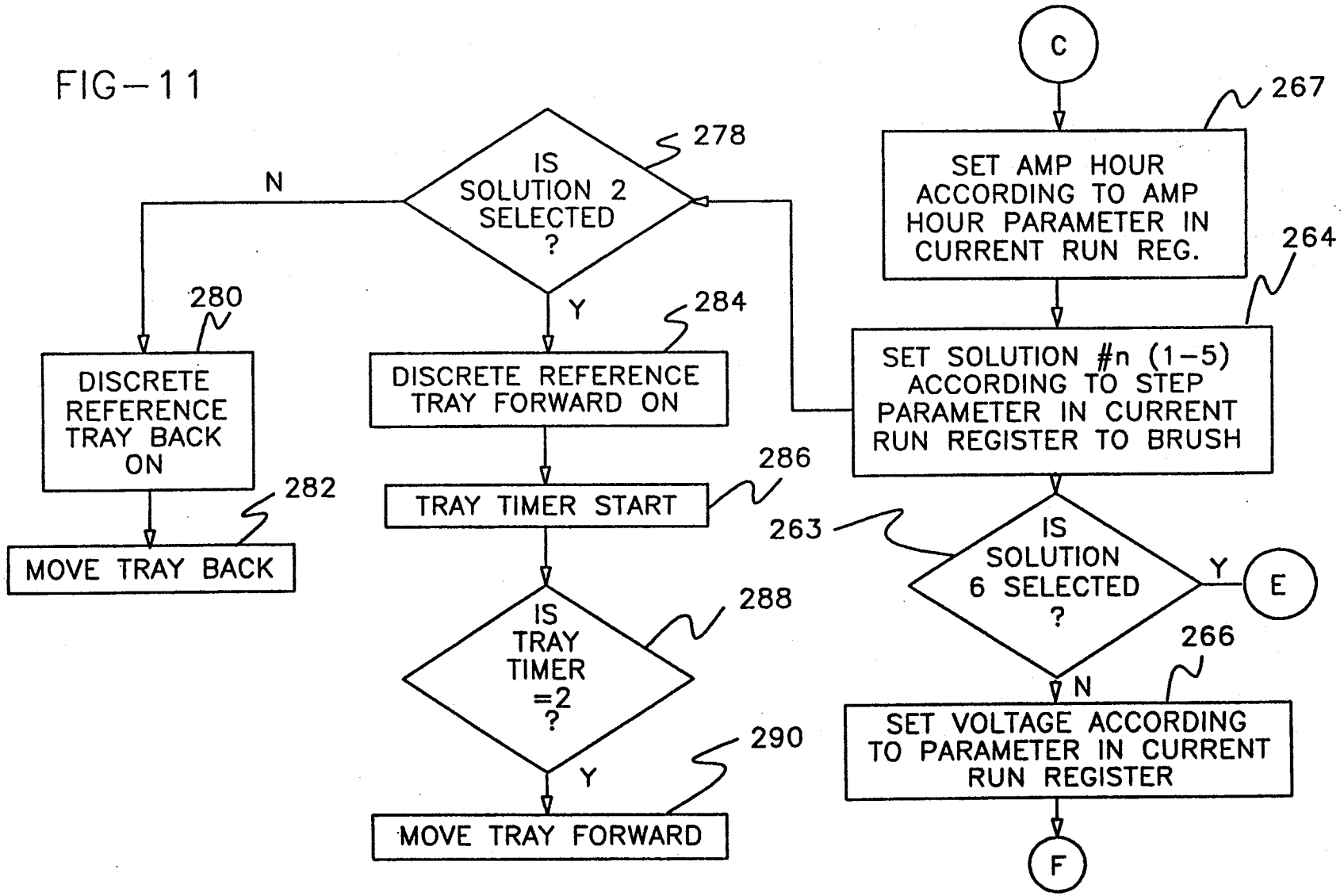
Figure 13:
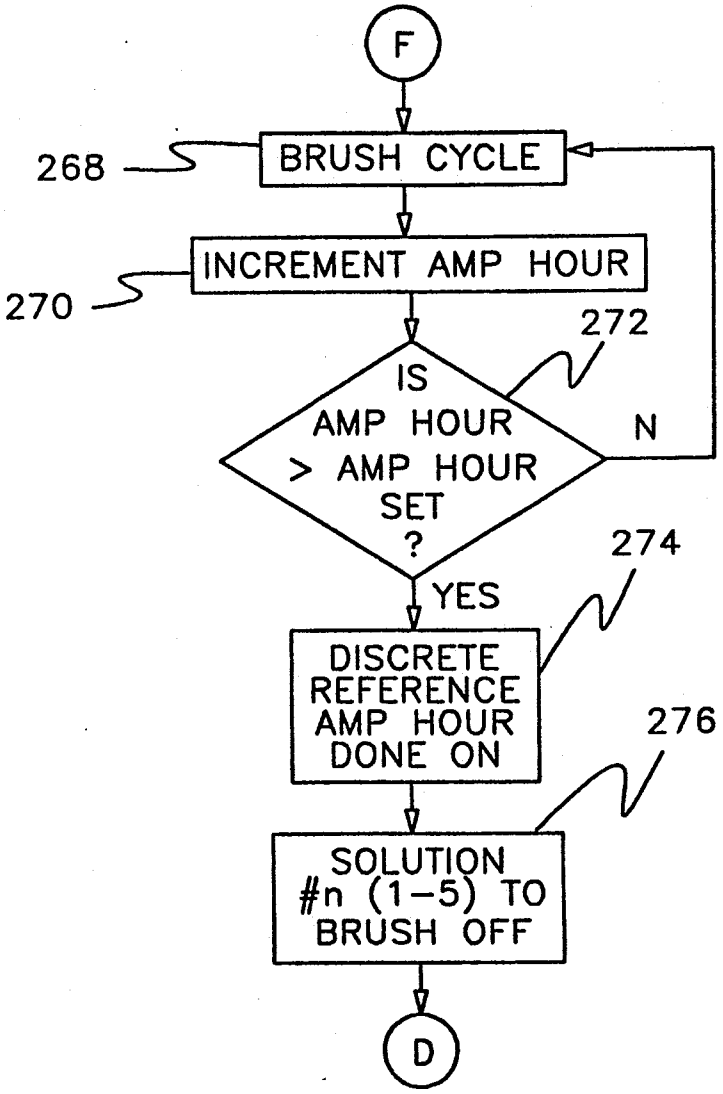
Figure 12:
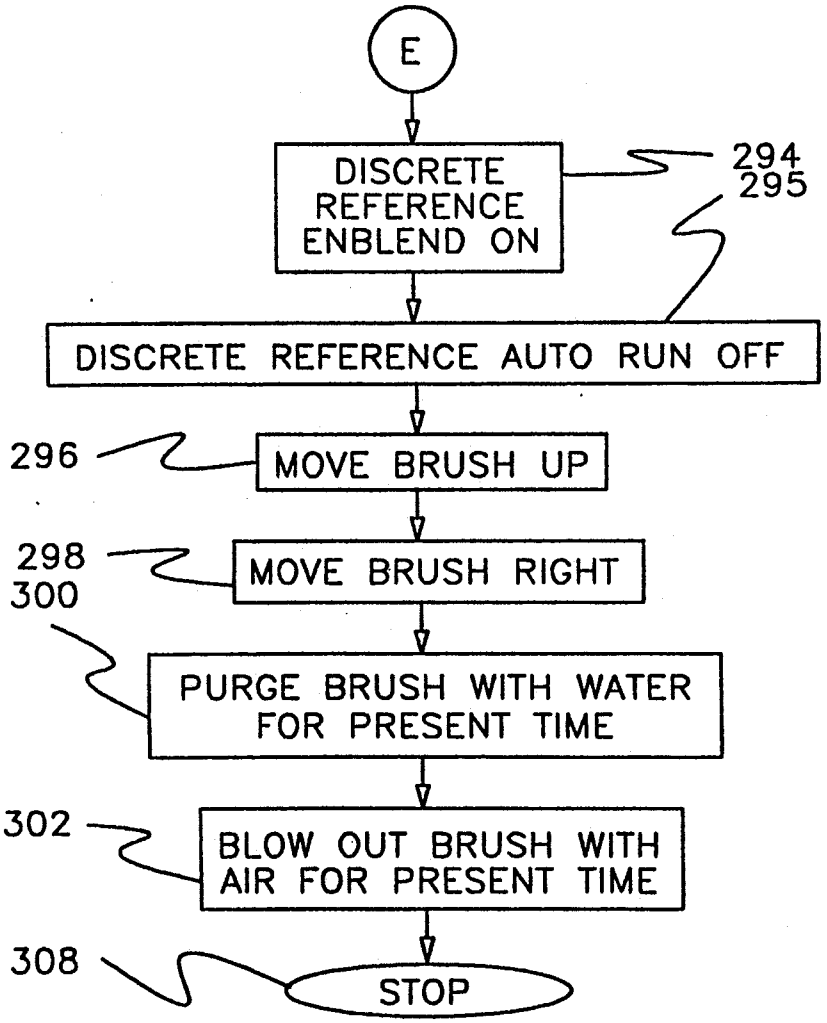

Once the current run register is filled with the step parameters 238, the controller looks at the amp hour parameters for that step and sets the power pack 20 accordingly 267 (FIG. 11). As stated above, the controller looks at the string of bits in the current run register and looks at the amp hour bit that tells it what the amp hours should be set at. Next, the controller looks at the current run register's solution bit 264 to determine which solution is to be supplied to the brush for the current step 264, followed by the voltage bit 266, and voltage polarity bit 266.

Once the parameters are set on the machine for the step, the brush is cycled continuously from left to right and right to left 268 (FIG. 13) by alternating the air supply to the band cylinder of rail 14 via solenoid 34*k* (FIG. 6). The controller increments 270 and keeps track of the amp hours being applied to the target throughout the cycling of the brush. The brush is continually cycled until the amp hours that have flowed through the brush exceed the preset amp hour limit 272. Once the preset limit is exceeded 272, the controller first turns on the discrete reference AMP HOUR DONE 274 then shuts off the solution to the brush 276.

Figure 14:
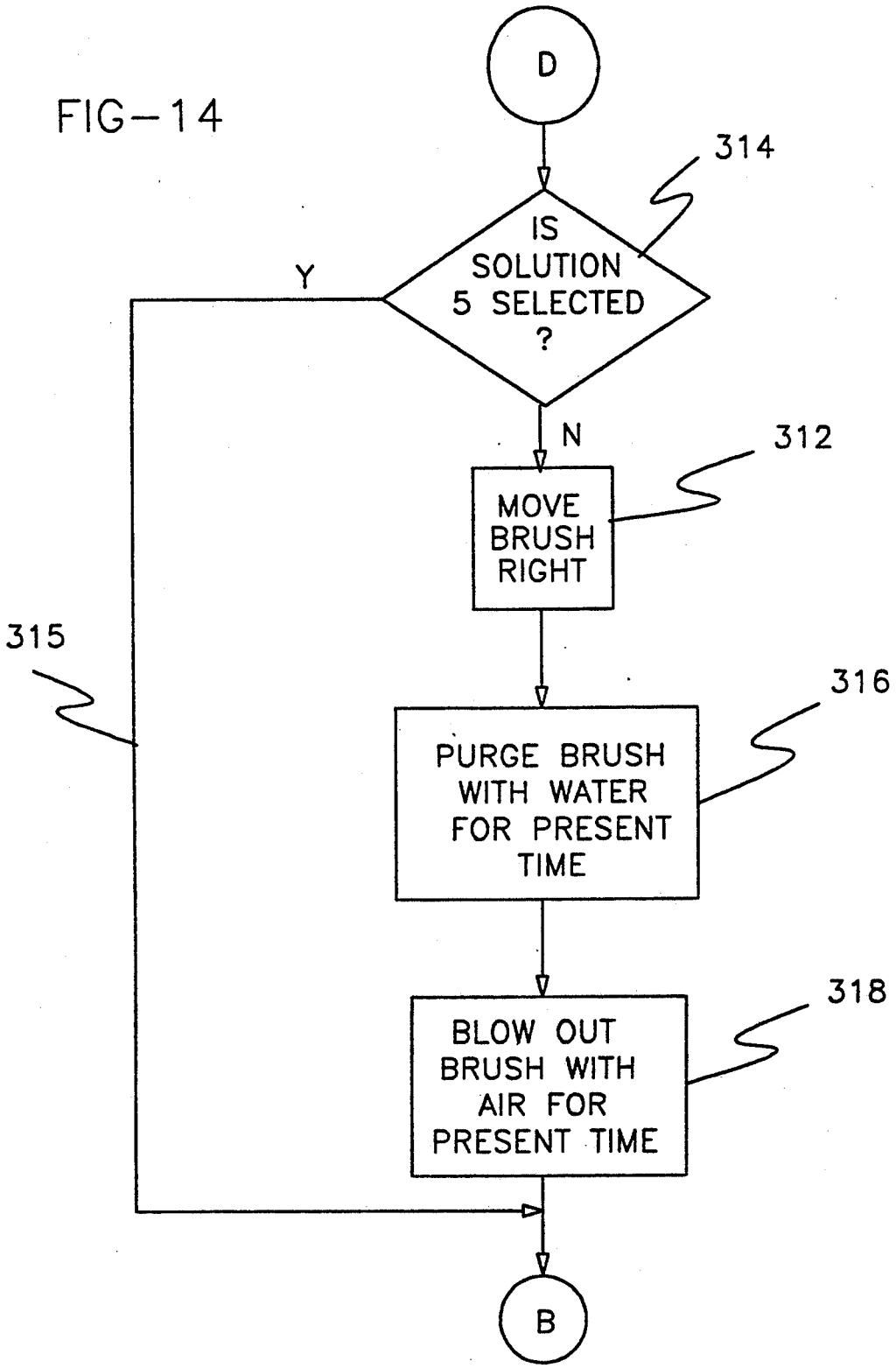

Referring to FIG. 14, if solution 5 was used in the previous step, which is a solution that for some reason should not be purged out of the brush, then the program continues onto the next step 315. If Solution 5 was not previously used, then the brush is moved to the right 312, or home, purged with water 316 for a preset time and blown out with air for a preset time 318. After the brush is blown out the program cycle begins again with each step of the program being implemented until all steps are completed.

Figure 9:
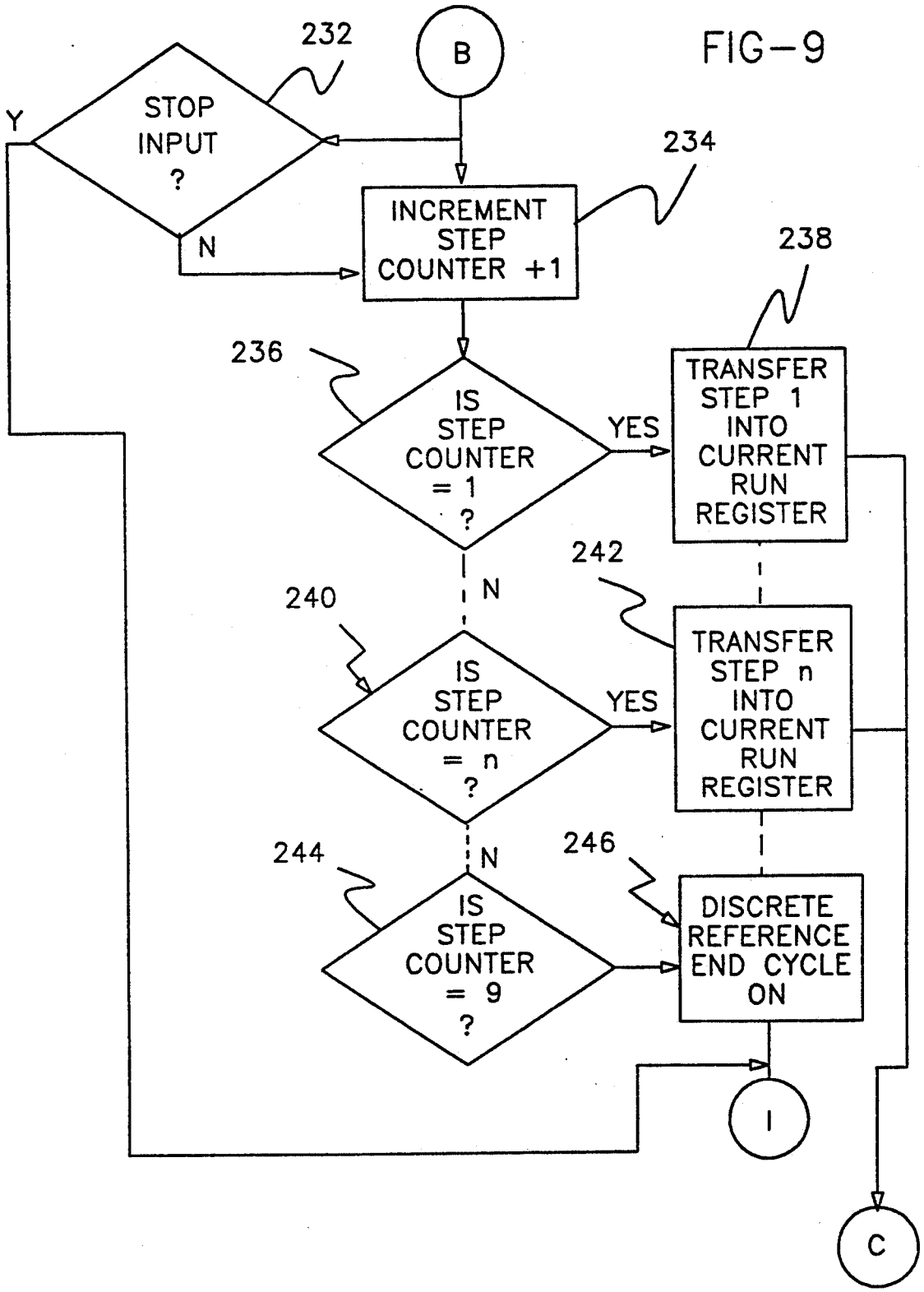
Figure 10:
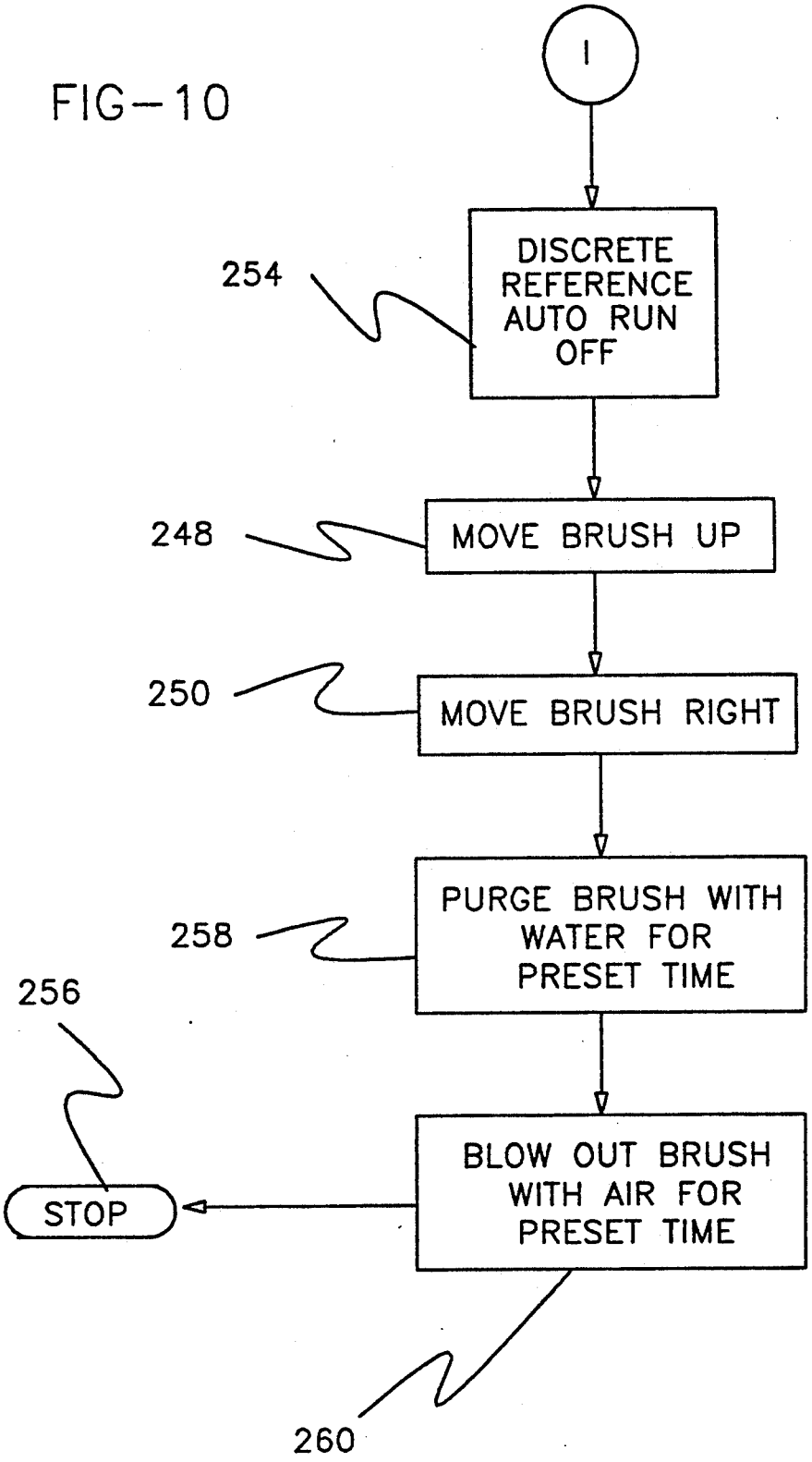

In FIG. 9, once the last step of the program, Step 8, is completed, the counter is incremented to 9, 244 which tells the controller to turn on the discrete reference END CYCLE 246. Following the END CYCLE on, 246, the controller turns off the discrete reference AUTORUN 254 (FIG. 10), the controller then moves the brush up 248 to the right 250, at which time the brush is given its final flush 258 with deionized water and blown out with air 260. When the brush is flushed out, it is flushed out with water 258 for a preset time, for example, 60 seconds, and then blown out with air 260 for a preset time, for example, 60 seconds.

Referring to FIG. 11, the program has been set up so that if the solution is set to 6 in any step, before the step counter is incremented to 9, then the controller is informed that the program has less than 8 steps and is finished cycling. Solution 6 is a null selection which indicates to the controller that the program is finished.

If the solution in the subsequent step is 6 (FIG. 11) 263, then the controller turns on the discrete reference ENABLE END 294 (FIG. 12) and turns off the discrete reference AUTORUN 295. Once again the brush is moved up 296, to the right 298, purged with water 300 and blown out with air 302. Following the blowing out of the blush 302, the program stops 308.

Referring back to FIG. 11, and the selection of the solution 264, the program has been set up so that if the solution used is Solution 2, which contains a material that is valuable or hazardous and needs to be recovered separately (such as an expensive gold, silver, platinum or nickel plating solution), then a separate section of the tray 24 is used. If the controller determines that Solution 2 has been selected 278, then the controller turns on the discrete reference TRAY FORWARD 284, and a timer begins to count the time 286. This timer is used for timing a predetermined amount of time it takes for the Solution 2 to soak through the brush, enter onto the plate and run off into the tray 24. Once the timer reaches the preset time, such as two minutes 288, the tray 24 is moved forward by air cylinder 44 and the run-off of Solution 2 is caught in the separate section of the tray (for example, tray section 24*b*). The run-off enters a discrete container for disposal or recovery.

If the step using solution 2 is complete then the controller turns on the discrete reference TRAY BACK, 280 and the tray 24 is moved back 282 so that portion 24*a* is positioned under the substrate. If Solution 2 has not been used 278, then the controller maintains the discrete reference TRAY BACK 280 on and the tray is maintained in the back position 282, wherein portion 24*a* is positioned under the substrate. In this position, all of the solutions, including the water, are run-off of the target and caught into a container for proper disposal or recovery therefrom.

Once each step has been completed, as stated above, if solution 5 is not used, the brush is flushed and blown out. Following the blowing out of the brush, the program increments the step counter 234 (FIG. 9) and the process is continued until solution 6 is read or the counter reaches Step 9 of the program wherein the program is stopped as stated above.

It should be noted that this is only one type of program that can be used to control the present invention and various programs can be written which can accomplish the same method of brush plating. Furthermore, to reiterate, the controller can have the capability of being programmed to run an infinite amount of programs with an infinite amount of steps, solutions, voltages, and amp hour parameters.

It is apparent that brush assembly 12 may be sequentially provided with any one of the five working solutions from pumps 18*a*–18*e* and their associated reservoirs. At any time between supply of individual working solutions to brush assembly 12, the brush may be washed with D.I. water from line 100 and/or purged with air from line 92.

Additionally, the tray 24 can be selectively moved fore and aft so that either portion 24a or 24b will be positioned under the substrate to catch run-off of the working solution. During the plating operation, the anode 26 and associated brush assembly 12 move back and forth along the substrate driven via pneumatic operation of rail 14 (i.e., the band cylinder). Plating control is achieved by measuring amp/hours consumed during a given program step.

As to the working solutions that are supplied to the pumps 18a–18e, they may comprise conventional cleansing and plating compositions. For example, traditional nickel, copper, chromium, zinc, cadmium, tin, lead, silver, gold, brass, bronze, platinum, and rhodium plating solutions can be mentioned with acidic or basic cleansing solutions being contemplated. A variety of substrates, including steel, copper, aluminum, molybdenum, etc., are contemplated. Moreover, even though a single rectangular substrate 16 is shown in the drawings and envisioned for subsequent usage as a sputter target, a plurality of disc-shaped or other shaped substrate articles could be positioned in an array along support 21 so that they may be plated.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Electrodeposition apparatus for depositing one or more of a plurality of working solutions on a substrate, said apparatus comprising:

(a) support means for supporting said substrate;

(b) movable electrode means;

(c) charging means connected to said support means (a) and said movable electrode means (b) for creating an electrical potential between said substrate and said electrode means (b);

(d) fluid supply means communicating with said movable electrode means (b) for selectively supplying one or more of said working solutions to said movable electrode means (b); and (e) transport means for automatically moving said movable electrode means (b) along a surface of said support means, a pressurized air source in communication with said fluid supply means (d); said fluid supply means (d) comprising control means (f) for selectively supplying either pressurized air or one or more of said working solutions to said movable electrode means (b).

2. Apparatus as recited in claim 1 further comprising a water source in communication with said fluid supply means (d); said control means (f) further including means for selectively feeding said water to said movable electrode head (b).

3. Apparatus as recited in claim 1 further comprising a movable tray means (g) disposed below said support means for receiving run off working solution from said fluid supply means (d) not deposited on said substrate.

4. Apparatus as recited in claim 3 wherein said tray means (g) comprises a pair of individual compartments, and wherein said tray means comprises positioning means for selectively moving said tray between alternate positions in which either one or the other of said individual compartments is disposed below said support means for receiving said run-off working solution.

5. Electrodeposition apparatus for depositing a plurality of working solutions on a substrate, said apparatus comprising:

(a) support means for supporting said substrate;

(b) movable electrode means;

(c) means for imparting opposite electrical polarities to said substrate and said movable electrode means (b);

(d) a plurality of working solution reservoirs, each adapted to contain either an electroplating or cleansing solution;

(e) fluid supply means communicating with said liquid reservoirs (d) and said movable electrode means(b);

(f) control means for sequentially supplying selected working solutions to said movable electrode means (b); and (g) transport means for automatically moving said movable electrode means (b) along a surface of said support means supporting said substrate.

6. Apparatus as recited in claim 5 further comprising a source of pressurized air, said fluid supply means also communicating with said pressurized air source, and including controllable valve means for selectively supplying said pressurized air to said movable electrode means (b).

7. Apparatus as recited in claim 6 further comprising a water flow line, said fluid supply means also communicating with said water flow line and including controllable valve means for selectively supplying water to said movable electrode means (b).

8. Apparatus as recited in claim 7 comprising a movable tray disposed below said support means for receiving run-off working solution from said fluid supply means (d) not deposited on said substrate, said tray comprising a pair of individual compartments, tray transport means connected to said tray for selectively moving said tray between alternate positions in which either one or the other of said individual compartments is disposed below said support means for receiving said run-off.

9. Apparatus for electrodeposition of a working solution on a substrate comprising:

a) support means for supporting said substrate in a fixed horizontal position, the surface of said substrate defining a horizontal plane;

b) a brush positioned adjacent to the surface of the substrate;

c) supply means connected to said brush for supplying said working solution to said brush;

d) transport means for moving said brush across the surface of said substrate;

e) charging means for providing an electrical potential between said surface of the substrate and said brush for electrodepositing said working solution from said brush to said substrate; and f) control means connected to said supply means (c) for controlling the amount of working solution electrodeposited onto the surface of said substrate, said control means comprising monitoring means for monitoring the amount of electricity flowing through said brush and substrate and shutting off said supply of working solution to said brush when said amount exceeds a predetermined level.

10. The apparatus according to claim 9 wherein said transport means comprises a pneumatic cylinder connected to said brush, and a programmable controller controlling actuation of said pneumatic cylinder.

11. The apparatus according to claim 9 wherein said supply means comprises a plurality of working solution reservoirs, a pump communicating with each reservoir, a programmable controller means actuating each said pump to provide for selective, sequential supply of working solution from said reservoirs to said brush.

* * * * *